United States Patent [19]

Staats

[11] 4,340,224

[45] Jul. 20, 1982

[54] GOALKEEPER'S HOCKEY STICK

[76] Inventor: Hilton S. Staats, R.R. #6, Hagersville, Ontario N0H 1H0, Canada

[21] Appl. No.: 188,423

[22] Filed: Sep. 18, 1980

[30] Foreign Application Priority Data

Jul. 16, 1980 [CA] Canada ..... 356282

[51] Int. Cl.[3] ..... A63B 59/12

[52] U.S. Cl. ..... 273/67 A

[58] Field of Search ..... 273/67 R, 67 A, 73 R, 273/73 C, 73 D, 76, 326, 167 J, 173; D21/210

[56] References Cited

U.S. PATENT DOCUMENTS

| | | | |
|---|---|---|---|
| 1,183,473 | 5/1916 | McNiece | 273/67 A |
| 2,142,527 | 1/1939 | Pool | 273/326 |
| 2,912,245 | 11/1959 | Gardner et al. | 273/67 |
| 3,458,194 | 7/1969 | Coles | 273/67 |
| 3,561,760 | 2/1971 | Klay | 273/67 |
| 3,563,546 | 2/1971 | Dawe | 273/67 |
| 3,591,178 | 7/1971 | Milligan | 273/326 |
| 3,809,401 | 5/1974 | Hankele | 273/67 A |
| 4,013,288 | 3/1977 | Goverde | 273/67 A |
| 4,076,240 | 2/1978 | Haddad | 273/67 A |
| 4,084,818 | 4/1978 | Goupil et al. | 273/67 A |
| 4,124,208 | 11/1978 | Burns | 273/67 A |
| 4,148,482 | 4/1979 | Harwell, Jr. et al. | 273/67 A |

FOREIGN PATENT DOCUMENTS

| | | | |
|---|---|---|---|
| 329964 | 2/1933 | Canada . | |
| 428225 | 4/1911 | France | 273/67 R |
| 1643 | of 1894 | United Kingdom | 273/73 D |
| 23845 | of 1906 | United Kingdom | 273/67 A |
| 2717 | of 1909 | United Kingdom | 273/67 A |

*Primary Examiner*—Richard J. Apley

*Attorney, Agent, or Firm*—Beveridge, DeGrandi and Kline

[57] ABSTRACT

A goalkeeper's hockey stick has a woven or laced fabric section in the blade portion so as to absorb the force of a puck striking the blade area and thereby reduce rebound. The widened portion of the shaft may also be provided with a mesh construction.

1 Claim, 3 Drawing Figures

GOALKEEPER'S HOCKEY STICK

BACKGROUND OF THE INVENTION

This application relates to hockey sticks and in particular to the stick used by goalkeepers. One of the problems facing goalkeepers during hockey games is the rebounding of the puck from the blade and sometimes the widened shaft portion of the goalie's stick. Many goals are scored from the rebound or deflection made from the original shot. Goalkeepers attempt to cushion the contact of the puck against the stick so that they can trap the puck with their glove and thereby control the direction which the puck will subsequently take. However, sometimes a shot on the net will occur so fast that the goalie does not have time to place himself in a position where he can effectively cushion the drive. As a result, the goalkeeper may stop the original drive of the puck with the blade or widened shaft portion of his stick to prevent the original shot from going into the net but the puck may rebound or deflect out to the same or another shooter who will subsequently put the puck behind the goalkeeper.

SUMMARY OF THE INVENTION

The present invention minimizes the possibilities of rebounds of a hockey puck thereby reducing the chance of scores being attained from rebounds or deflections off the goalkeeper's stick.

In accordance with a broad aspect, the present invention relates to a goalkeeper's hockey stick having a handle, widened shaft portion and blade. The blade has a perimeter frame structure defining an open blade area and a mesh formation covers the blade area and is secured to the perimeter frame. The mesh formation consists of a resilient material so as to absorb the force of a puck striking the blade area and thereby reduce the rebound factor.

The widened shaft portion may also include a perimeter frame structure defining a further open area and a further resilient mesh formation is secured in the perimeter frame of the shaft portion.

In a preferred embodiment, the frame of the stick is formed of moulded plastic and the mesh formation consists of leather or nylon thongs woven or laced across the open areas into apertures in the frame.

BRIEF DESCRIPTION OF THE DRAWINGS

The invention is illustrated by way of example in the accompanying drawings in which.

DESCRIPTION OF THE PREFERRED EMBODIMENT

Figures 1, 2, 3:
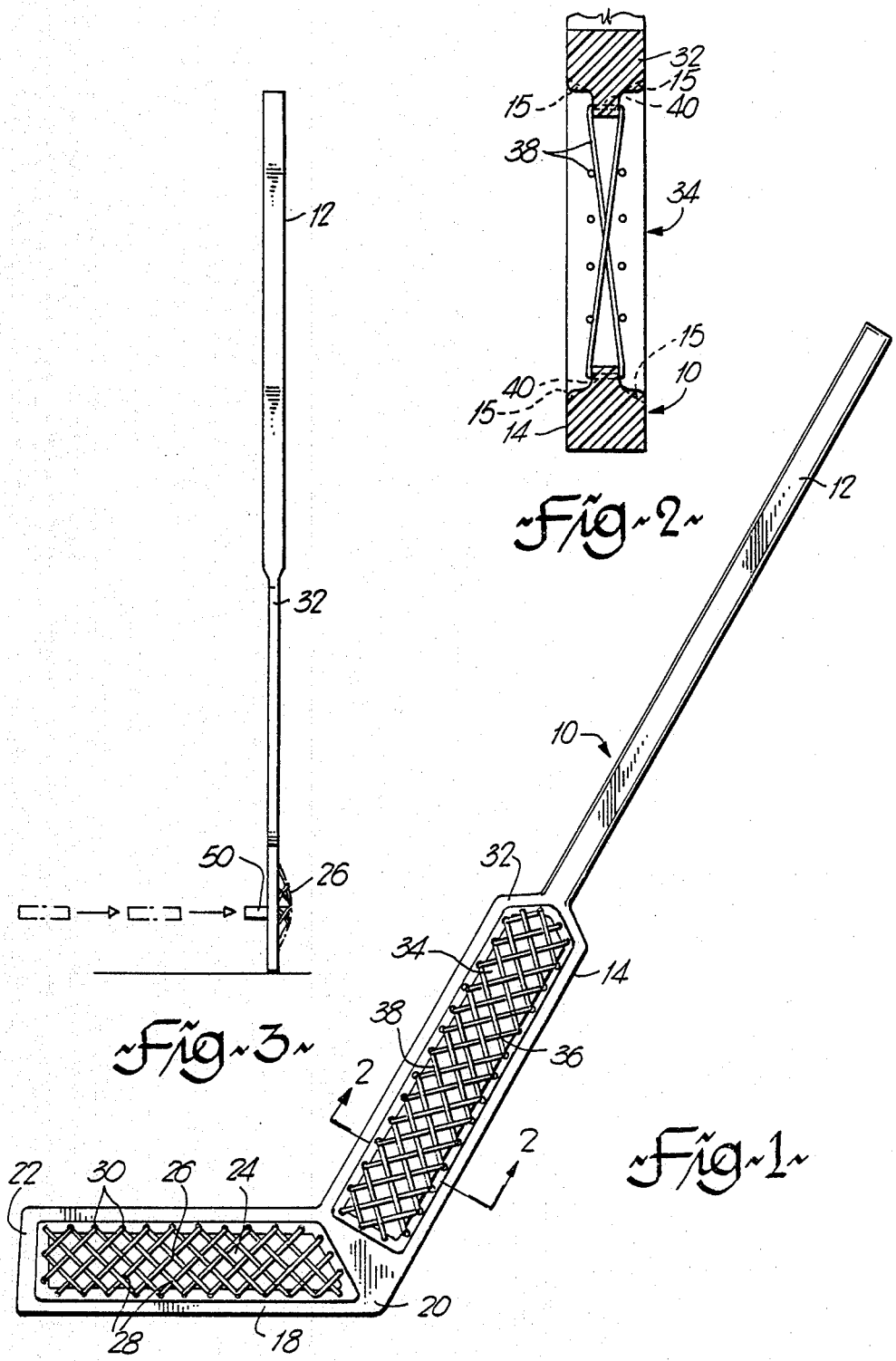
FIG. 1 is an elevation view of a goalkeeper's hockey stick according to the present invention.
FIG. 2 is a sectional view along the line 2—2 of FIG. 1.
FIG. 3 is a perspective view of a goalkeeper's stick according to the invention showing the shock absorbency of the structure.

Referring to FIG. 1, a goalkeeper's hockey stick indicated generally at 10 has a shaft or handle 12, a widened shaft portion 14 and blade 16.

While the stick of the present invention can be made of wood, aluminum or other substance, it is preferred that the structure be manufactured in a moulded plastic so as to provide the blade 16 with a perimeter frame 18 extending generally from the heel 20 to the toe 22. The frame 18 defines a central or open blade area 24, the portion of the stick that is most frequently contacted by a puck during a game of hockey. A mesh formation 26 covers the area 24 and preferably consists of nylon or leather thongs 28 laced or woven through apertures 30 in the perimeter frame. In one example, the apertures 30 measure approximately 3/32 of an inch in diameter and the apertures are close enough to restrict the passage of a standard size hockey puck through the blade area 24 but loose enough to restrict rebound of the puck from the blade area of the stick.

The widened shaft portion may also be provided with a rebound restricting portion as well as the blade. As shown in FIGS. 1 and 2, the shaft portion 14 may also be formed as a perimeter frame 32 with an open central area 34. A mesh formation 36 consisting of leather or nylon thongs 38 are laced or otherwise suitably connected to the frame structure 32 by virtue of apertures 40 in the frame as shown in FIG. 2. As shown in dashed lines, the perimeter of the frame could be chamfered as at 15 to direct shots into the mesh area and further reduce rebound.

FIG. 3 illustrates the method by which the mesh area 26 of the blade 16 absorbs the shock of a puck 50 shot at the stick.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitation, and there is no intention in the use of such terms and expressions to exclude any equivalents of the features shown and described or portions thereof, but it is recognized that various modifications are possible within the scope of the invention claimed.

I claim:

1. A goalkeeper's hockey stick comprising an elongated stick-like handle portion having a longitudinal axis, a flat shaft portion extending from a lower end of the handle portion and aligned with the longitudinal axis thereof, said flat shaft portion being wider than the handle portion and having opposed longitudinally-extending straight sides parallel to said longitudinal axis, and a flat blade portion extending from a lower end of and inclined to the flat shaft portion, said blade portion having parallel upper and lower straight edges extending from respective sides of the shaft portion, with the shaft portion and handle portion being inclined to the horizontal away from the blade portion when the upper and lower edges of the blade portion are horizontal, the shaft portion and the blade portion each having a continuous perimeter frame defining an open blade area and an open shaft area respectively, said blade area and said shaft area each being open to both sides of said hockey stick, and a resilient mesh formation in each area secured to the perimeter frame thereof and operable to absorb the force of a hockey puck striking the respective area.

* * * * *